United States Patent [19]

Marino et al.

[11] Patent Number: 4,868,946

[45] Date of Patent: Sep. 26, 1989

[54] ADJUSTABLE ROLLER FRAME

[75] Inventors: Frank Marino, Baldwin, N.Y.; Howard Graves, Berlin, Ohio

[73] Assignee: The Wooster Brush Company, Wooster, Ohio

[21] Appl. No.: 257,977

[22] Filed: Oct. 14, 1988

[51] Int. Cl.[4] ..... B05C 1/08; B05C 17/02

[52] U.S. Cl. ..... 15/230.11; 29/110.5

[58] Field of Search ..... 15/230.11, 104 A, 144 R; 29/110.5, 120, 116.1

[56] References Cited

U.S. PATENT DOCUMENTS

| | | | |
|---|---|---|---|
| 2,702,917 | 3/1955 | Lynden | 15/230.11 |
| 2,805,436 | 9/1957 | Christensen et al. . | |
| 2,970,366 | 2/1961 | Gill | 29/110 |
| 3,229,319 | 1/1966 | Goetz | 15/230.11 |
| 3,310,831 | 3/1967 | Brinker . | |
| 3,340,562 | 9/1967 | Skandaliaris . | |
| 3,593,361 | 7/1971 | Welt | 15/230.11 |
| 3,604,046 | 9/1971 | Taylor | 15/230.11 |
| 3,745,624 | 7/1973 | Newman | 29/116 |

*Primary Examiner*—Edward L. Roberts

*Attorney, Agent, or Firm*—Renner, Otto, Boisselle & Sklar

[57] ABSTRACT

Adjustable roller frame includes a body member and clamp member having laterally spaced apart grooves in opposing surfaces thereof which cooperate to define a pair of laterally spaced generally parallel guideways for sliding receipt of a pair of roller support arms. The arms are made of metal tubing bent into a generally L-shape including a short leg and long leg. Each long leg is deformed from opposite sides over a portion of its length to form a pair of relatively sharp corners extending the length of the deformed portion while generally maintaining the radius of the tubing between the corners to minimize internal stresses in the tubing. Between the corners and normal tube radius is a radiused transition area. The cooperating grooves in the body and clamp members have a combined shape generally corresponding to the deformed shape of the long legs of the arms and include notches which receive the corners on the arms for supporting the arms against rotation while permitting relative axial sliding movement of the arms in the grooves. The notches in the body member are spaced further apart than the notches in the clamp member to cause a towing in of the short legs to bring roller end mounts on the short legs into coaxial alignment with each other.

26 Claims, 2 Drawing Sheets

ADJUSTABLE ROLLER FRAME

BACKGROUND OF THE INVENTION

This invention relates generally as indicated to an adjustable roller frame for supporting rollers of different lengths and diameters. Typically such rollers may vary in length, for example, from 9 inches to 18 inches and vary in diameter from 1½ inches to 2¼ inches, and are used for applying paint or other protective coatings or sealers to relatively large flat surfaces such as floors, walls, etc.

It is already known to provide adjustable roller frames of this same general type including a pair of generally L-shape support arms mounted for relative axial sliding movement in opposite directions toward and away from each other to adjust the spacing between opposed end portions for supporting rollers of different lengths therebetween. However, there is a continuing need for a low maintenance adjustable roller frame having relatively few parts that will withstand considerable abuse, and still provide dor the easy removal and replacement of rollers of different lengths.

SUMMARY OF THE INVENTION

According to the present invention, in one aspect there is provided an adjustable roller frame including a releasable clamp member for releasably clamping a pair of axially slidable support arms in axially adjusted position to a body member for ease of assembly and disassembly of rollers of different lengths between opposed ends of the support arms. The clamp and body members have recesses or grooves therein which cooperate to define a pair of laterally spaced generally parallel guideways for sliding receipt of the support arms therein.

Preferably, the support arms are substantially identical so as to be interchangeable and are made out of thin-walled metal tubing bent into a generally L-shape, including a short leg and long leg. The long leg is deformed from opposite sides over a portion of its length to form a pair of diametrically opposite corners extending the length of the deformed portion while generally maintaining the radius of the tubing between the corners to minimize internal stresses in the tubing. Between the corners and normal tube radius are radiused transition areas.

Also according to the invention, the cooperating grooves in the body and clamp members have a shape substantially corresponding to the cross sectional shape of the deformed portions of the arms including notched portions which receive the corners for supporting the arms against rotation while permitting relative axial sliding movement of the arms in opposite directions for adjusting the longitudinal spacing between the short legs of the arms.

Furthermore, the grooves in the body and clamp members are generally parallel to each other, but are slightly rotated in opposite directions so that the notched portions of the grooves which receive the corners on the deformed portions of the arms are spaced further apart in the body member than in the clamp member to bring stub shafts on the short legs of the arms into coaxial alignment with each other for rotatably supporting a roller coaxially between such stub shafts.

In accordance with another aspect of the invention, the axial inner ends of the deformed portions of the support arms form stops limiting axial inward sliding movement of the support arms beyond the deformed portions. Also, caps or buttons are desirably inserted into the distal ends of the long legs of the support arms which further act as stops limiting axial outward sliding movement of the support arms relative to the clamp and body members.

Further in accordance with the invention, the support arms may be frictionally held in the desired longitudinally adjusted position upon tightening fastener means extending through the body and clamp members between the support arms.

In accordance with another aspect of the invention, the body and clamp members are desirably keyed together to help absorb the torque loads which are applied to the adjustable roller frame during use.

In accordance with still another aspect of the invention, the body member may be provided with a handle socket having a flexible tongue on one side to facilitate clamping of the handle against the opposite side of the socket upon tightening of one or more fasteners passing through aligned holes in the handle, tongue and socket wall opposite the tongue.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
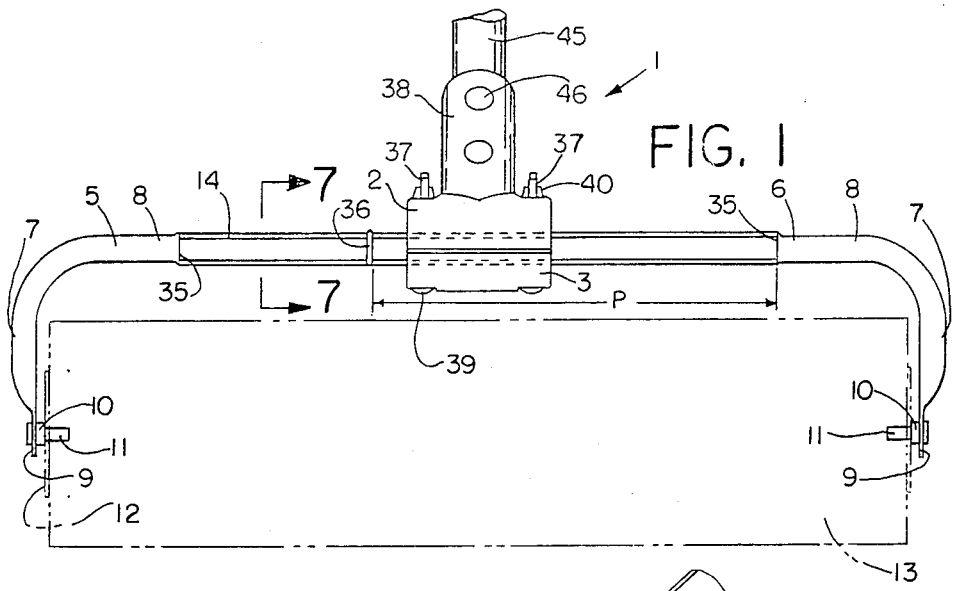
FIG. 1 is a front elevation view of a preferred form of adjustable roller frame according to the present invention.
Figure 2:
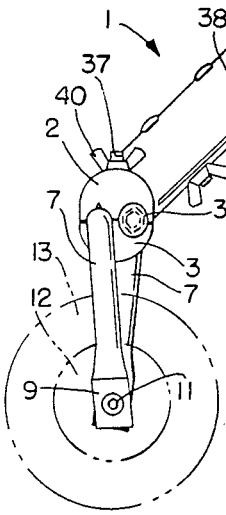
FIG. 2 is an end elevation view of the adjustable roller frame of FIG. 1 as seen from the right end thereof.

Referring now in detail to the drawings, and initially to FIGS. 1 and 2 thereof, a preferred form of adjustable roller assembly in accordance with this invention is generally indicated by the reference numeral 1 and includes a main body or support member 2 and associated clamp member 3 for supporting a pair of rod-like support arms 5, 6 for axial sliding movement in opposite directions toward and away from each other. Both support arms 5, 6 are desirably identical so that they are interchangeable, and are preferably made of thin-walled metal tubing bent into a generally L-shape including a short leg 7 and long leg 8. The short leg 7 is desirably flattened at its distal end 9 and has a hole punched therethrough from the inside out. Inserted into the hole from the inside is a stud 10 which may be secured in place as by riveting from the outside. Such studs 10 include inwardly facing stub shafts 11 which are adapted to be received in holes in end caps 12 in the ends of a roller 13, shown in phantom lines in FIGS. 1 and 2.

Figure 3:
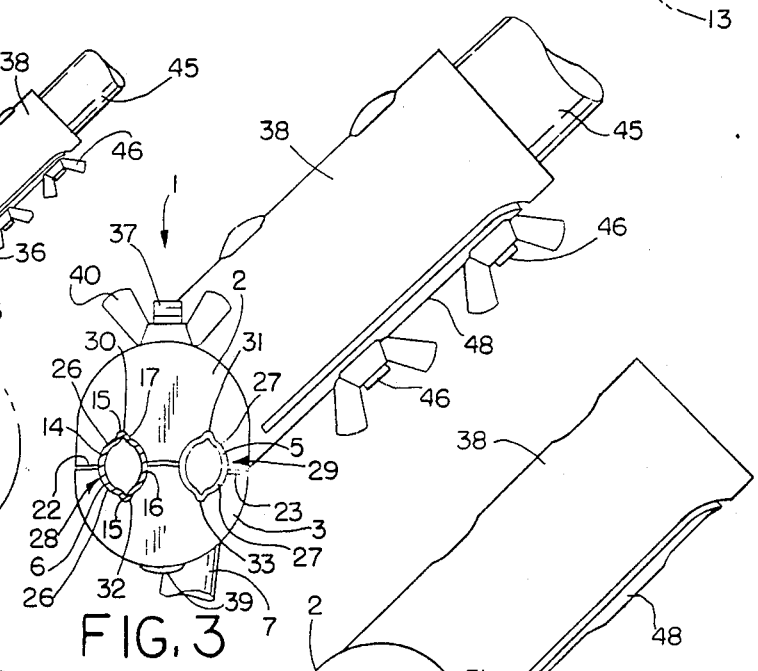
FIG. 3 is an enlarged fragmentary end elevation view of the adjustable roller frame similar to FIG. 2, but with one of the roller support arms being shown in section and the other support arm having a plug removed from a distal end thereof.
Figure 7:
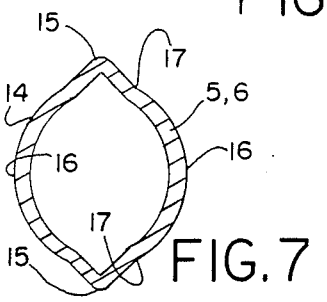
FIG. 7 is an enlarged transverse section through one of the support arms of the adjustable roller frame of FIG. 1, taken generally along the plane of the line 7—7.
Figure 4:
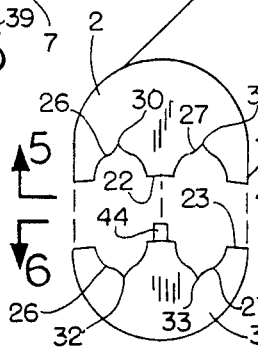
FIG. 4 is an enlarged exploded side elevation view of the body and clamp members of the adjustable roller frame of FIGS. 1–3.

The long leg 8 of each support arm 5, 6 is deformed from opposite sides over a portion P of its length to form a pair of diametrically opposite rib-like corners 15 while generally washing the normal radius of the tubing in the regions 16 between such corners 15 to minimize internal stresses in the tubing during such deformation (see FIGS. 3 and 7). Between the corners 15 and normal tube radius regions 16 are radiused transition areas 17 which provide a smooth transition therebetween.

Figure 6:
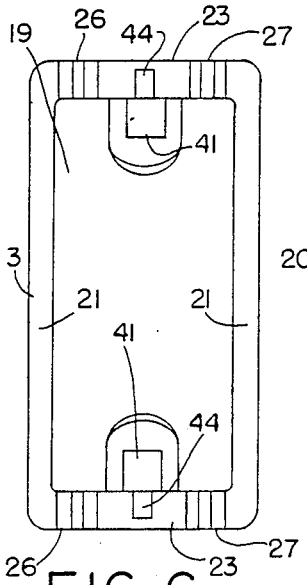
FIG. 6 is an internal plan view of the clamp member of FIG. 4 as generally seen from the plane of the line 6—6 thereof.
Figure 5:
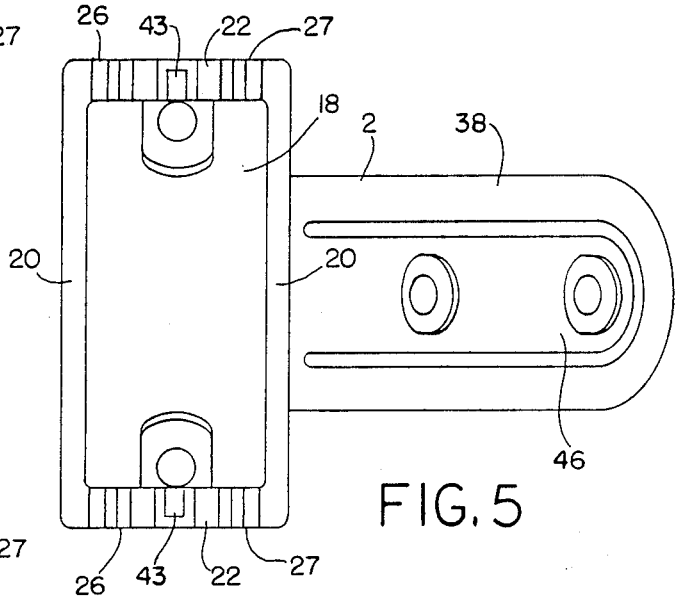
FIG. 5 is an internal plan view of the body member of FIG. 4 as generally seen from the plane of the line 5—5 thereof.

The body and clamp members 2, 3 are desirably molded out of a suitable plastic material and preferably include generally hollow interiors 18 and 19 to save weight and material costs (see FIGS. 5 and 6). Circumscribing the body and clamp members 2, 3, are side walls 20, 21 and end walls 22, 23. Each end wall 22, 23 has two laterally spaced, generally parallel recesses or grooves 26, 27 therein.

As seen in FIGS. 3 an 4, the recesses or grooves 26, 27 in the body member 2 cooperate with the corresponding recesses or grooves 26, 27 in the clamp member 3 to form guideways 28, 29 therebetween having a shape generally corresponding to the cross-sectional shape of the deformed portions 14 of the long legs 8 of support arms 5, 6. Such guideways 28, 29 support the arms 5, 6 against rotation while permitting relative sliding movement of the arms in opposite directions toward and away from each other for adjusting the longitudinal spacing between the stub shafts 11 for ease of assembly and removal of rollers 13 of different lengths therebetween.

Such guideways 28, 29 are generally parallel to each other, but are rotated slightly in opposite directions so that the notched portions 30, 31 of the grooves 26, 27 in the body member 2 which receive the corners 15 on the deformed portions 14 of the arms 5, 6 are spaced further apart than the notched portions 32, 33 in the clamp member 3. This causes a "towing in" of the short legs 7 of the arms 5, 6 to bring the stub shafts 11 into coaxial alignment with each other for coaxially supporting a roller 13 on the stub shafts 11 as illustrated in FIG. 2.

The maximum and minimum spacing between the opposed flattened ends 9 of the support arms 5, 6 will be determined by the overall lengths of the support arms and deformed portions 14 on the long legs 8 thereof as well as the lengths of the body and clamp members 2, 3. As an example, the support arms 5, 6 may have an overall length from the distal end of the long legs 8 to the inside face of the flattened end portions 9 of the short legs 7 of approximately eleven inches, and the deformed portions 14 of the long legs 8 may have an overall length of approximately eight inches. Also, the body and clamp members 2, 3 may have an overall length of approximately three inches. Such an adjustable roller frame 1 of these dimensions will provide an adjustment of approximately nine inches to eighteen inches between the opposed ends 9 of the arms 5, 6.

The arms 5, 6 may for example be made out of 20-gauge thinwalled metal tubing having an outer diameter (O.D.) of approximately onehalf inch. Also, the distance from the O.D. of the long legs 8 to the centerline of the stub shafts 11 may be approximately three and one-half inches. Furthermore, suitable indicia, not shown, may be provided along the length of the support arms 5, 6 indicating the spacing between the opposed ends 9 of the arms 5, 6 for accommodating rollers of different lengths.

The axial inner ends 35 of the deformed portions 14 of the support arms 5, 6 act as stops limiting axial inward movement of the support arms relative to the body and support members 5, 6. Also, end plugs or buttons 36 may be pressed into the distal ends of the long legs 8 of the support arms 5, 6 to act as stops limiting axial outward movement of the support arms relative to the body and clamp members.

Such body and support members 2, 3 are maintained in the desired assembled relation by one or more fasteners 37 which when tightened frictionally clamp the support arms 5, 6 against axial sliding movement within the guideways 28, 29. In the preferred embodiment disclosed herein, two such fasteners 37 are provided, each extending between the two support arms 5, 6 through aligned openings in the body and clamp members on opposite sides of a handle socket 38 centrally located on the side of the body member 2 opposite the grooves 26, 27. The outer end of each hole may be countersunk to provide a flat surface for engagement by the bolt head 39 and wing nut 40 of each fastener. Also, the holes 41 in the clamp member 3 may be square for non-turning receipt of square shank portions on the fasteners 37 to keep the fasteners from rotating during tightening and loosening of the wing nuts 40.

To prevent all of the torque loads from being transmitted to the fasteners 37 of the adjustable roller frame 1 during use, the body and clamp members 2, 3 are desirably keyed together at opposite ends as by providing a pair of pockets or slots 43 in the end walls 22 of the body member 2 for receipt of correspondingly shaped outwardly protruding tabs or pins 44 on the end walls 23 of the clamp member 3.

A handle 45 may be retained in the handle socket 38 in body member 2 as by means of a pair of fasteners 46 extending through aligned holes in the socket 38 and handle 45. To facilitate clamping of the handle 45 against one side of the handle socket 38, the other side of the handle socket may be provided with a flexible tongue 48, with openings therethrough for receipt of the fasteners. Upon tightening of the fasteners 46, the tongue 48 will flex toward the opposite wall of the socket 38 firmly clamping the handle 45 in place.

From the foregoing, it will now be apparent that the adjustable roller frame of the present invention is of a unique design which provides for easy removal and replacement of rollers of different lengths and diameters. Also, the adjustable roller frame is relatively light in weight and yet will withstand the relatively heavy loads that are applied thereto when the operator presses down hard on the handle during use.

Although the invention has been shown and described with respect to a certain preferred embodiment, it is obvious that equivalent alterations and modifications will occur to others skilled in the art upon the reading and understanding of the specification. The present invention includes all such alterations and modifications, and is only limited by the scope of the claims.

What is claimed is:

1. An adjustable roller frame comprising a body member and clamp member having opposed surfaces containing laterally spaced apart groove means which cooperate to define a pair of laterally spaced, generally parallel guideways, a pair of support arms axially slidably received in said guideways, said support arms having opposite end portions for supporting a roller therebetween, and means mounting said body member and clamp member for relative movement into and out of clamping engagement with opposite sides of said support arms for releasably clamping said support arms against axial movement in said guideways.

2. The adjustable roller frame of claim 1 wherein said support arms are generally L-shape including a first leg axially slidably received in said guideways and a second leg extending generally at right angles to said first leg, said support arms facing in opposite directions in said guideways and being movable in opposite directions to move said second legs toward and away from each other to vary the spacing between said second legs for removably mounting a roller between said second legs.

3. The adjustable roller frame of claim 2 wherein said second legs have roller mounts thereon, and said guideways maintain the orientation of said roller mounts in coaxial alignment with each other during axial sliding movement of said support arms in said guideways.

4. The adjustable roller frame of claim 2 wherein said second legs have coaxially aligned support means thereon for rotatably supporting the ends of a roller therebetween.

5. The adjustable roller frame of claim 4 wherein said support means comprises stub shafts on said second legs.

6. The adjustable roller frame of claim 2 wherein said guideways are non-circular in shape, and said first leg of each said support arm has a corresponding non-circular shape over a portion of its length which is slidably received in said guideways to prevent relative rotational movement of said support arms in said guideways while permitting relative axial sliding movement therebetween.

7. The adjustable roller frame of claim 6 wherein said support arms are made of thin-walled metal tubing, and a portion of the length of said first leg of each said support arm is deformed to provide such non-circular shape.

8. The adjustable roller frame of claim 7 wherein the axial inner end of the deformed portion of said first leg provides a stop limiting axial inward movement of said support arms relative to said body and clamp members.

9. The adjustable roller frame of claim 7 wherein such deformed portion of said first leg is deformed from opposite sides to form diametrically opposite corners while maintaining the normal radius of said metal tubing in regions between said corners.

10. The adjustable roller frame of claim 9 further comprising radiused transition areas between said corners and normal tube radius regions.

11. The adjustable roller frame of claim 9 wherein said groove means in said body and support members have notches therein for receipt of said corners on said deformed portions of said first legs, said notches in said body member being spaced further apart than said notches in said clamp member to cause a towing in of said short legs to bring roller end mounts on said short legs into coaxial alignment with each other.

12. The adjustable roller frame of claim 2 wherein said means mounting said body and clamp members for relative movement comprises fastener means extending through aligned openings in said body and support members and between said guideways and support arms.

13. The adjustable roller frame of claim 12 wherein there are two of said fastener means extending through aligned openings in said body and support members and between said guideways and support arms.

14. The adjustable roller frame of claim 12 further comprising handle attachment means on said body member opposite said groove means in said body member, said handle attachment means being located intermediate the length of said body member.

15. The adjustable roller frame of claim 14 wherein there are two of said fastener means extending through aligned openings in said body and support members and between said guideways and support arms on opposite sides of said handle attachment means.

16. The adjustable roller frame of claim 14 wherein said handle attachment means comprises a handle socket having a cantilevered tongue in one side, a handle received in said handle socket, and additional fastener means extending through aligned openings in said tongue and handle and a wall portion of said handle socket opposite said tongue, whereupon tightening of said additional fastener means will cause said tongue to flex inwardly toward said wall portion to assist in clamping said handle against said wall portion.

17. The adjustable roller frame of claim 2 further comprising means for keying said body and clamp members together to prevent relative lateral movement between said body and clamp members in a direction generally parallel to said opposed surfaces while permitting relative movement of said body and clamp members in a direction generally perpendicular to said opposed surfaces.

18. The adjustable roller frame of claim 17 wherein said means for keying comprises pocket means in one of said members and pin means on the other of said members received in said pocket means.

19. The adjustable roller frame of claim 18 wherein there are two of said pocket means and two of said pin means at opposite ends of said members.

20. The adjustable roller frame of claim 1 wherein said body and support members have end walls at opposite ends thereof, and said groove means comprises two laterally spaced apart grooves in each of said end walls.

21. An adjustable roller frame comprising a body member and clamp member having opposed surfaces containing spaced apart groove means defining a pair of generally parallel guideways therebetween, a pair of roller support arms axially slidably received in said guideways, and means for moving said clamp member toward said body member to clamp said roller support arms in said guideways, said roller support arms being generally L-shape including a first leg axially slidably received in said guideways and a second leg extending generally perpendicular to said first leg, said roller support arms facing in opposite directions in said guideways and being movable in opposite directions to move said second legs toward and away from each other to vary the spacing between said second legs, said second legs having roller end mounts for rotatably supporting the ends of a roller therebetween, said roller support arms being made of metal tubing, said first leg of each said roller support arm being deformed from opposite sides for a portion of the length of said first leg to form diametrically opposite corners while maintaining the normal radius of said metal tubing in regions between said corners, and radiused transition areas between said corners and said normal radiused regions, and said guideways having a shape generally corresponding to the deformed portions of said first legs which are slidably received in said guideways to prevent relative rotation of said roller support arms in said guideways while permitting relative axial sliding movement therebetween.

22. The adjustable roller frame of claim 21 wherein said groove means in said body and support members having notches therein for receipt of said corners on said deformed portions of said first legs, said notches in said body member being spaced further apart than said notches in said clamp member to angularly orient said second legs relative to each other so that said second legs radially overlap to maintain said roller end mounts on said second legs in coaxial alignment with each other.

23. The adjustable roller frame of claim 21 wherein the axial inner ends of said deformed portions of said first legs provide stops limiting axial inward movement of said roller support arms relative to said body and clamp members.

24. The adjustable roller frame of claim 23 further comprising plug means in the distal ends of said first legs providing further stops limiting axial outward movement of said roller support arms relative to said body and clamp members.

25. The adjustable roller frame of claim 21 wherein said body and clamp members are made of molded plastic, with hollow interiors and end and side walls circumscribing said members, and said groove means comprises two laterally spaced apart grooves in each of said end walls.

26. The adjustable roller frame of claim 25 further comprising pocket means in said end walls of one of said members and pin means extending from said end walls of the other of said members into said pocket means for keying said members together.

* * * * *